United States Patent [19]

Brickman

[11] Patent Number: 4,732,234

[45] Date of Patent: Mar. 22, 1988

[54] PERIMETER SAFETY NET SYSTEM FOR MULTI-STORY BUILDINGS UNDER CONSTRUCTION

[76] Inventor: Morley Brickman, 5240 Galitz, Skokie, Ill. 60077

[21] Appl. No.: 93,959

[22] Filed: Sep. 8, 1987

[51] Int. Cl.[4] ..... E04G 21/32

[52] U.S. Cl. ..... 182/138; 182/82

[58] Field of Search ..... 182/82, 137, 138, 139

[56] References Cited

U.S. PATENT DOCUMENTS

| | | | |
|---|---|---|---|
| 753,326 | 7/1904 | Smith . | |
| 1,012,947 | 3/1911 | Weisfeld . | |
| 1,546,399 | 7/1925 | Moylan . | |
| 2,122,908 | 7/1938 | Collins | 182/82 |
| 2,142,651 | 1/1939 | Michelson | 182/82 |
| 3,533,487 | 9/1970 | Norin . | |
| 3,921,757 | 11/1975 | Kennedy . | |
| 3,949,834 | 4/1976 | Nusbaum . | |
| 4,074,791 | 2/1978 | Inman . | |
| 4,119,176 | 10/1978 | Verdu . | |
| 4,129,197 | 12/1978 | Preston . | |

FOREIGN PATENT DOCUMENTS

| | | | |
|---|---|---|---|
| 71253 | 4/1959 | France | 182/138 |

OTHER PUBLICATIONS

"Sinco" Handbook of Passive Fall Protection Copyright 1985.

*Primary Examiner*—Reinaldo P. Machado

*Attorney, Agent, or Firm*—McCaleb, Lucas & Brugman

[57] ABSTRACT

A safety system for a multi-story building under construction includes parallel, vertical stationary guide channels or tracks secured to the side of the building. Vertically moveable slide rails are slidably mounted within the guide channels. Cantilever struts extend diagonally upwardly and outwardly from connections with the slide rails. A safety net extends along the building with its outer edge anchored at the outer ends of the struts and with its inner edge anchored on the moveable slide rails. Vertical chains or cables are connected between the slide rails and a construction crane at the top of the building to lift the slide rails and net while in an extended condition to a new working position. Brakes acting between the slide rails and guide channels automatically release to enable upward movement and automatically lock to hold the net in the new working position.

8 Claims, 9 Drawing Figures

FIG. 1
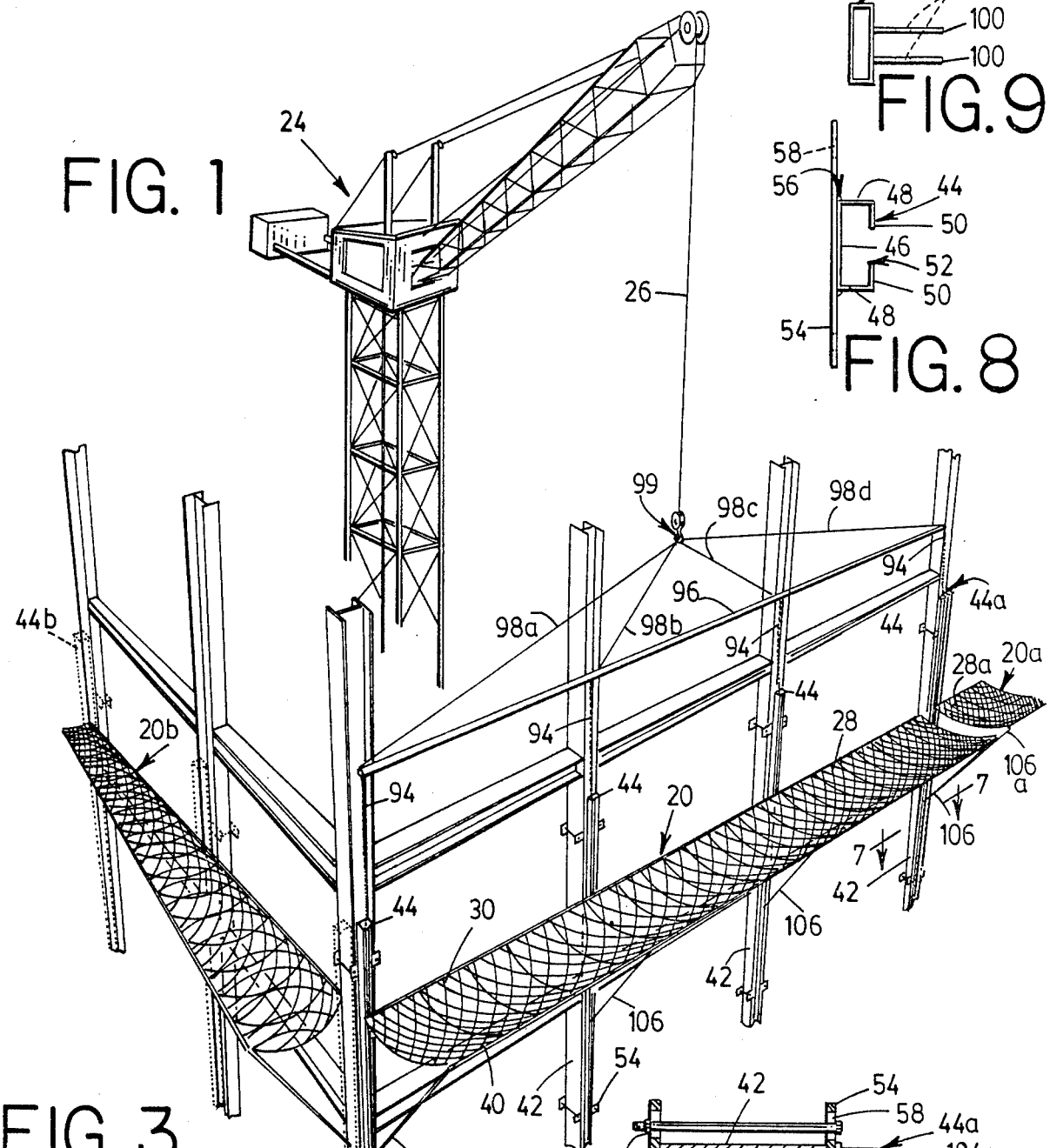
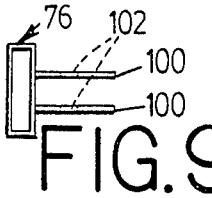
FIG. 9
FIG. 8
FIG. 3
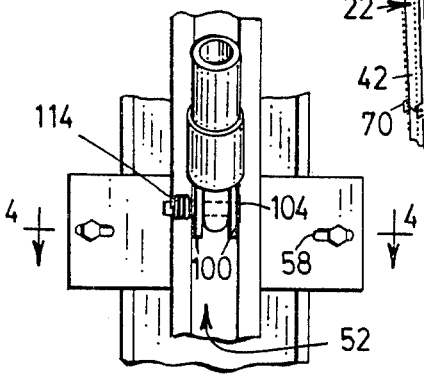
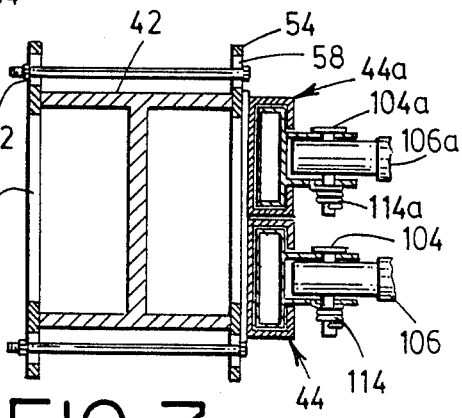
FIG. 7

FIG. 2
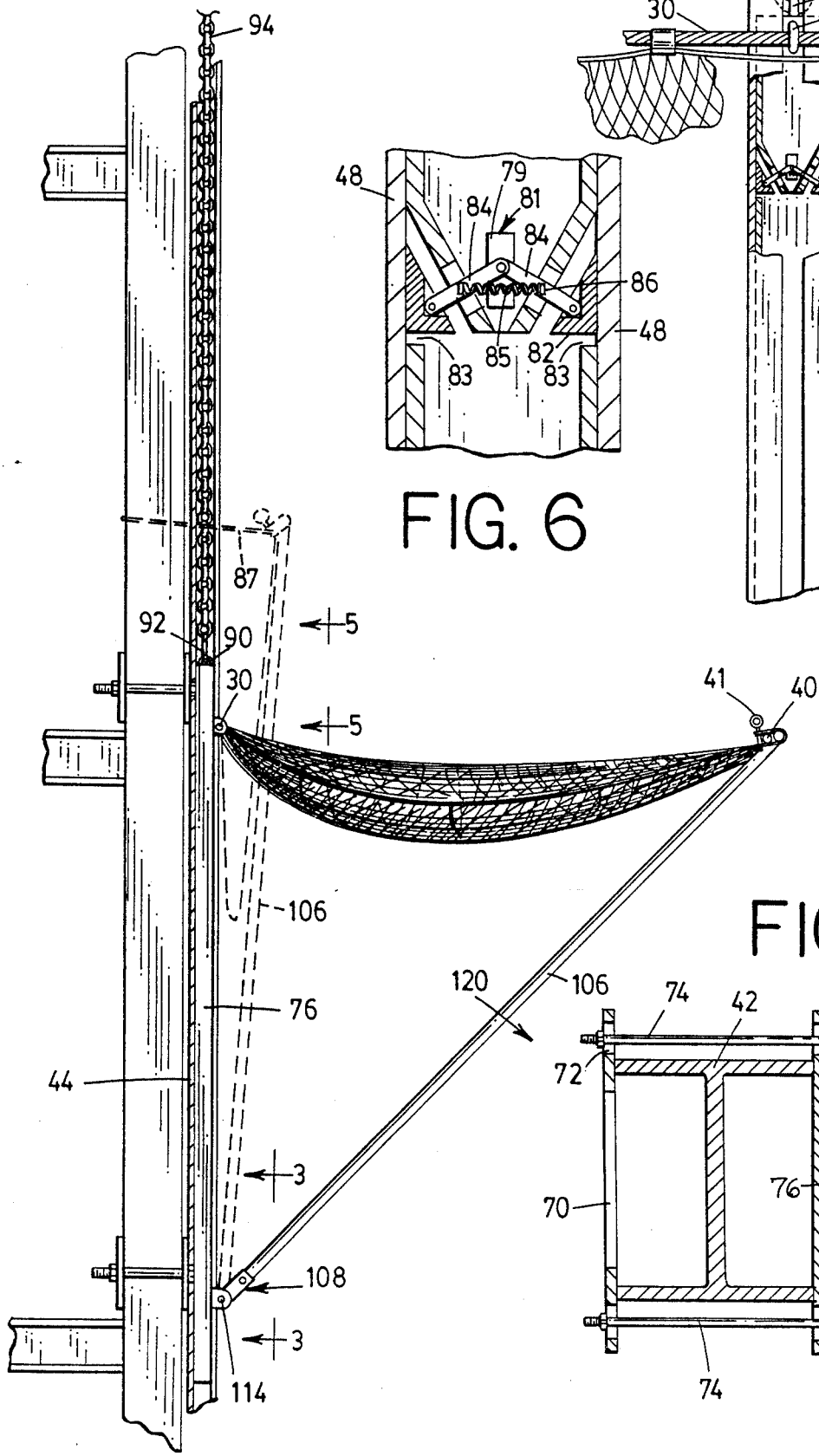
FIG. 6
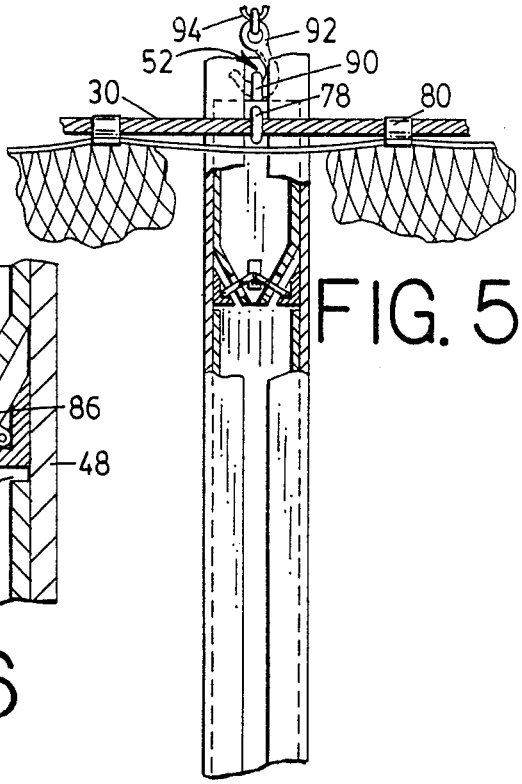
FIG. 5
FIG. 4
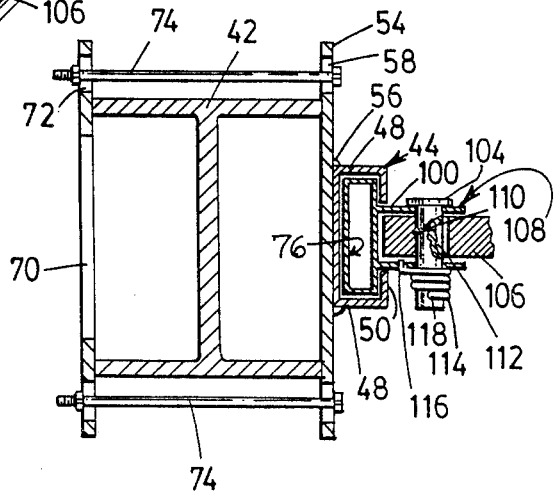

PERIMETER SAFETY NET SYSTEM FOR MULTI-STORY BUILDINGS UNDER CONSTRUCTION

BACKGROUND OF THE INVENTION

In construction of multi-story buildings, there is a double hazard that workers may fall causing severe injury or death to themselves, and tools and equipment may fall causing injury or death to people below.

To prevent such accidents, some safety standards require nets to be installed along the perimeter of the building just below the level of work being performed, but in no event should the dropping distance exceed about twenty five feet. As floors are added in a building under construction, the net is raised.

One form of safety net system which is widely used is shown in Arthur Nusbaum U.S. Pat. No. 3,949,834 entitled "Safety Net and Adjustable Support Therefor". While this is effective from a safety standpoint, it has a serious drawback in that lifting the net from one floor to the next requires that it be disassembled at the one floor, and the components moved to the next floor and reassembled there. This is time-consuming, takes workers away from their duties, and interferes with construction. For a fifty-story building, this may have to be done up to fifty times.

There is a need for such a safety net system which can be lifted from one floor to the next in a minimum of time and minimum delay of the work in progress.

BRIEF SUMMARY OF THE INVENTION

The general object of this invention is to provide a safety net system for the perimeter of a multi-story building under construction.

An object of this invention is to provide such a safety net system which can be moved upwardly from floor to floor as construction of the building progresses, without dismantling and re-assembling it.

Another object is to provide such a safety net system which can be moved upwardly from floor to floor in fully extended condition and be ready for use immediately.

Another object is to provide such a safety net system which is readily retractable flatwise against the building to provide clearance for construction equipment and supplies being hoisted alongside the building.

Another object is to provide such a safety net system which is readily retractable flatwise against the building and the outer edge raisable so that debris, which may fall into the net, can be easily removed.

BRIEF DESCRIPTION OF THE DRAWINGS

Other objects and advantages will be apparent from the following description taken in connection with the drawings in which:

FIG. 1 is a perspective view of a safety net system and adjustable support therefor illustrating a preferred form of the present invention;

FIG. 2 is a fragmentary enlarged side view, partially in cross-section, of FIG. 1;

FIG. 3 is a fragmentary enlarged view of FIG. 2 taken in the direction of arrows 3—3;

FIG. 4 is an enlarged cross-section of FIG. 3 taken along line 4—4;

FIG. 5 is a fragmentary enlarged view of FIG. 2 taken in the direction of arrows 5—5;

FIG. 6 is a fragmentary enlarged view of FIG. 5;

FIG. 7 is a fragmentary enlarged cross-section of FIG. 1 taken along line 7—7; and FIGS. 8 and 9 are separate illustrations of the suite channel arc slide rail respectively.

Like parts refer to like reference characters throughout the figures of the drawing.

DESCRIPTION OF THE PREFERRED EMBODIMENT

Referring now more specifically to the embodiment of the invention illustrated in the drawing, the safety net system comprises a plurality of nets 20,20A and 20B supported along the periphery of a multi-story building 22 under construction. A construction crane 24 has a hoisting cable 26 for lifting construction equipment and supplies in the usual manner. It also lifts the individual safety nets from floor to floor as will be described.

The nets 20,20A and 20B and their supports may be identical. Net 20 will be described with the understanding that it is representative.

Each net comprises a piece of netting fabric 28, having reinforced reinforcing ropes or cables 30 and 40 along the inner and outer edges respectively. The rope or cable 40 is fastened by any suitable means such as eye-bolts 41.

The net may be any suitable length depending on the lifting capacity of the crane, height of the building, wind conditions at the site, among other factors. In the present case, net 20 extends the distance of three spans between columns 42.

A vertical guide channel 44, best shown in FIGS. 4 and 8, is secured to each column 42. Each guide channel comprises a back web 46, side webs 48, and inwardly extending flanges 50 with a slot 52 between them. A pair of mounting plates 54 are fastened as by welding at 56 across each back web 46. Each mounting plate 54 has a pair of elongated bolt holes 58. Each mounting plate has a corresponding clamping plate 70 on the back side of column 42. Each clamping plate 70 also has a pair of elongated bolt holes 72. As best shown in FIG. 4, each guide channel 44 is secured to one of the columns 42 by bolts 74 which extend through bolt holes 58,72 in plates 54 and 70 respectively.

A vertically moveable slide rail 76, best shown in FIGS. 4 and 9, is slidably mounted within each guide channel 44. As shown in FIG. 9, this has a hollow, rectangular box beam cross-section. At the upper end section, each has an eye 78 extending outwardly through the slot 52 and acting as an anchor for the inner reinforcing rope 30. This rope is connected to the inner edge of the netting fabric material by clamps 80.

As best shown in FIGS. 5 and 6, brake means 81 is provided at the upper end portion of the slide rail 76. It comprises a pair of brake shoes 82 engageable with the side webs 48. These brake shoes extend through side openings 83 in the slide rail and are pivotally connected to a center boss 79 by links 84. A compression spring 85 bears outwardly on pads 86 on these links thereby biasing the brake shoes into frictional engagement with the guide channel side webs 48.

The weight of the slide rail and net tends to spread the links 84 and increase the frictional contact. Upward movement, as by pull exerted by chains 94, tends to contract the links 84 and release the frictional contact so the slide rails and net can be lifted without brake resistance. Thus, the brake means is automatically self-locking in a downward direction and automatically self-releasing in an upward direction.

As shown in FIGS. 1 and 7, at the column 42 which is common to nets 20 and 20A, there will be a pair of guide channels 44 and 44A. These will be identical as described above for channel 44 and associated parts, except that the components associated with guide channels 44A are identified by the same numerals with the suffix "A". A group of four guide channels 44A and associated components will support an adjacent net 20A as a continuation of net 20.

The guide channels 44 may be in lengths of, say, twenty feet or so, to extend over at least two stories. As the slide rails 76 move upwardly far enough to clear a lower set of guide channels 44, they may be removed and reinstalled higher as upper continuations of the guide channels engaging the slide rails 76. Thus, only two guide channels 44, each spanning about two stories, may suffice for each column 42. Alternatively, as where construction work or major rehabilitation is being done on an existing building, or the building is relatively low, a single guide channel 44 may be secured to each column 42.

In the usual operation, the net or nets will be assembled around the outside of a building. They will be substantially horizontal and upwardly concave as shown in FIGS. 1 and 2. When it is necessary to hoist construction materials and supplies close to the building, a particular net or net section which would be in the way is pulled inwardly by ropes 87 (FIG. 2), flatwise alongside the building, against the bias of torsion springs 114. This retracted position is shown in broken lines in FIG. 2.

At its extreme top end, each slide rail 76 has an eye 90 for a lifting hook 92 at the end of hoisting chain 94. The four chains 94 are connected to a cross-bar or yoke 96 which is connected by cables 98A–98D to a hook 99 at the end of hoisting cable 26.

As best shown in FIGS. 3, 4, and 9, each slide rail 76 has a pair of horizontally spaced, vertical plate members 100 extending forwardly through the slot 52. These plate members have horizontallly aligned holes 102 through which a pivot pin 104 extends.

A cantilever strut 106 has a pivotal connection, generally designated 108, with the lower end of each slide rail 76. As best shown in FIG. 4, this connection includes a pin 104 which extends through a transverse bore 110 in the strut. A key 112 fastens the pin to the strut and causes it to rotate therewith. A torsion spring 114 has one end 116 engaged with an opening in one of the plate members 110 and its opposite end 118 engaged with an opening in the pin. The spring biases the strut outwardly in the direction of arrow 120 shown in FIG. 2.

As new floors are added, the nets will be raised by connecting the crane hook 99 to the ropes 98A–98D and lifting the respective slide rails 76 simultaneously. During this raising maneuver, the nets will be in their outward extended positions as shown in FIG. 2 and ready for use immediately. At the end of the construction, when the building is topped out, the netting fabric, guide channels, slide rails, and other components will be drawn up to the top of the building, bundled into compact packages, and lowered to the ground with the crane for use on the next job.

It will be apparent that the embodiment shown is exemplary only and that various modifications can be made in construction and arrangement within the scope of the invention as defined in the appended claims. For example, where the building frame is concrete instead of steel as illustrated, means for securing the guide channels 44 to concrete floor structures may be substituted for the steel column mounting and clamping plates 54 and 70 described.

The embodiments of the invention in which an exclusive property or privilege is claimed are defined as follows:

1. A safety net system for multi-story buildings under construction comprising:
   - at least two parallel, vertical, stationary guide channels secured to a side of the building;
   - a vertically moveable slide rail slidably mounted on each of said guide channels;
   - a cantilever strut extending diagonally upwardly and outwardly from a connection with each slide rail;
   - outer anchor means mounted at the outer end of each strut;
   - inner anchor means mounted on each slide rail above said connection;
   - a safety net supported between said inner and outer anchor means; and
   - hoist means attached to each of said slide rails to simultaneously lift said slide rails and raise said net while in an extended condition to a new working position.

2. A safety net system according to claim 1 having a pivotal connection between each strut and its corresponding slide rail, thereby enabling the net to be retracted to an out-of-the-way position against the building to clear construction materials and the like being hoisted alongside the building.

3. A safety net system according to claim 2 in which each said pivotal connection includes spring means biasing the corresponding strut toward an outward, extended position.

4. A safety net system according to claim 1 including brake means acting between each slide rail and the corresponding guide channel, means automatically responsive to lifting force applied by said hoist means to said slide rails to render said brake means ineffective and enable raising the net, and means automatically responsive to release of said lifting force to render the brake means effective and thereby hold the net at a predetermined level.

5. A safety net system according to claim 4 in which the brake means comprises a pair of brake shoes carried by each slide rail, said shoes being engagable with opposite side walls of the corresponding guide channel, biasing means biasing said brake shoes into braking engagement with the guide channel side walls, and means responsive to upward movement of said slide rails to release said brake means.

6. A safety net system according to claim 5 in which said biasing means is spring means.

7. A safety net system according to claim 1 in which each guide channel comprises a hollow box beam constructiion with an open slot in one side, said slide rail comprises a box beam construction slidably received within said guide channel, and having said connection with the cantilever strut, and another connection with the inner anchor means, extending through said open slot.

8. A safety net system according to claim 1 in which said hoist means includes a horizontal cross-bar extending across the top ends of the slide rails and are connected thereto by cable-like elements, and a crane at the top of the building is connected to lift said cross-bar, raise said slide rails, and elevate said safety net.

* * * * *